US008132610B2

(12) United States Patent
Lin

(10) Patent No.: US 8,132,610 B2
(45) Date of Patent: Mar. 13, 2012

(54) WINDOW COVERING

(75) Inventor: Tzong-Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 157 days.

(21) Appl. No.: 12/704,664

(22) Filed: Feb. 12, 2010

(65) Prior Publication Data

US 2011/0198044 A1 Aug. 18, 2011

(51) Int. Cl.
*A47G 5/02* (2006.01)

(52) U.S. Cl. ..... 160/243; 24/115 F

(58) Field of Classification Search ..... 160/243, 160/84.04, 178.1 R; 24/115 R–115 N
See application file for complete search history.

(56) References Cited

U.S. PATENT DOCUMENTS

| | | | | |
|---|---|---|---|---|
| 1,301,603 | A * | 4/1919 | Rathbun | 160/243 |
| 2,631,661 | A * | 3/1953 | Nelson | 160/133 |
| 3,125,790 | A | 3/1964 | Gaylord | |
| 3,246,685 | A * | 4/1966 | Anderson et al. | 160/133 |
| 4,909,298 | A | 3/1990 | Langhart | |
| 5,533,559 | A | 7/1996 | Judkins | |
| 5,566,735 | A | 10/1996 | Jelic | |
| 5,630,458 | A | 5/1997 | Holden | |
| 5,919,542 | A * | 7/1999 | Chou | 428/99 |
| 6,431,248 | B1 | 8/2002 | Hyman et al. | |
| 6,484,787 | B1 | 11/2002 | Walters | |
| 6,585,026 | B2 * | 7/2003 | Su et al. | 160/243 |
| 6,637,493 | B1 | 10/2003 | Lampers | |
| 6,817,399 | B2 | 11/2004 | Berman et al. | |
| 6,845,803 | B1 * | 1/2005 | Nien | 160/178.1 R |
| 6,860,312 | B2 | 3/2005 | Judkins | |
| 6,918,425 | B2 | 7/2005 | Nien | |
| 6,948,546 | B2 | 9/2005 | Nien | |
| 7,000,672 | B2 | 2/2006 | Nien | |
| 7,017,230 | B2 * | 3/2006 | Lin | 16/202 |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,302,738 | B2 * | 12/2007 | Nien et al. | 24/115 F |
| 7,318,251 | B2 | 1/2008 | Lin | |
| 2005/0022948 | A1 * | 2/2005 | Nien | 160/178.1 R |
| 2005/0087312 | A1 * | 4/2005 | Nien | 160/178.1 R |
| 2006/0144526 | A1 | 7/2006 | McGinley | |
| 2007/0023149 | A1 | 2/2007 | Lamars et al. | |
| 2008/0000054 | A1 * | 1/2008 | Huang | 24/115 F |
| 2008/0099165 | A1 * | 5/2008 | Birch | 160/243 |
| 2008/0110581 | A1 * | 5/2008 | Lin | 160/178.2 |

* cited by examiner

*Primary Examiner* — David Purol

(74) *Attorney, Agent, or Firm* — Buchanan Ingersoll & Rooney PC

(57) ABSTRACT

A window covering includes a first rail, window covering material, lift cords that extend from adjacent the first rail to the window covering material, and at least one pulley and at least one pulley release device. At least one pulley is positioned so that at least one lift cord passes along that pulley. Each pulley release device is attached to at least one respective pulley to releasably connect the one or more pulleys to the first rail. Each pulley release device is configured to permit the one or more pulleys to which it is attached to release from the first rail when a release force acts on a component of the pulley release device. Preferably, the one or more pulleys are positioned on the outside of the first rail adjacent to the window covering material. The one or more pulleys may also be positioned adjacent to a valance.

22 Claims, 7 Drawing Sheets

WINDOW COVERING

FIELD OF THE INVENTION

This invention relates to window coverings such as roll-up shades or Roman shades, and more particularly, to a child safety device that may be used for such window coverings.

BACKGROUND OF THE INVENTION

On occasion, children have been able to get entangled in one or more lift cords of a window covering. If the lift cord is around the child's neck and the child falls, the cord could act as a noose and strangle the child. There have been incidents of child entanglements in lift cords of venetian blinds, Roman shades, and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,431,248, 6,484,787, 5,630,458, 5,533,559 and 4,909,298 disclose child safety devices for window coverings. Child safety devices may be configured to keep the lift cords taught so that the cords cannot be pulled away from the window covering material and form a noose or release the cord from the shade when a child becomes entangled in the shade.

Roll-up shades typically include a headrail, window covering material that is configured to extend and retract adjacent to the headrail and lift cords that extend from the headrail to the window covering material. A cord lock is typically positioned on the headrail. Each lift cord usually extends from a cord lock positioned on the front of the shade. Each lift cord extends from the cord lock along the front surface of the window covering material, around a bottom edge of the window covering material, and upwards along the rear surface of the window covering material. A terminal end of each lift cord is typically affixed to the rear of the headrail. The other end of each lift cord typically extends out of the cord lock so a user may manipulate the cords and cord lock to raise or lower the window covering material. As the window covering material is raised, the window covering material is rolled upwards about its bottom edge. As the window covering material is lowered, the window covering material is unrolled about its bottom edge.

U.S. Pat. No. 7,318,251 discloses a roll-up shade that includes releasable cord connectors. Each releasable cord connector includes a male body and a female body. The male body is connected to an end of a lift cord and the female body is attached to the headrail of the shade. The female body is positioned on the rear face of the headrail of the roll-up shade. The male body is sized and configured to be releasably received within an opening formed in the female body adjacent to the rear of the shade. If a child becomes entangled within the lift cords, the male body may be released from the female body so that a child will not become entangled within the lift cord.

Roll-up shade cord lease devices are typically configured so that the cord release devices are only positioned on the rear face of the blind. However, there may still be a danger of entanglement that could occur along the front of a roll-up shade. If a child becomes entangled on a portion of a lift cord positioned on the front surface of the window covering material, the window covering material may interfere with the transfer of force along the lift cord such that a cord release device attached to a headrail adjacent the rear surface of the window covering material does not release or may not release unless a much larger than desirable force acts on the lift cord. As a result, there may be a danger of entanglement with a portion of a cord positioned along the front surface of window covering material that is not addressed by safety mechanisms for roll-up shades disclosed in the prior art, such as U.S. Pat. No. 7,318,251.

A new safety mechanism is needed for window coverings such as roll-up shades to prevent children from becoming entangled within cords of the window covering. Preferably, the new safety mechanism provides a sensitive safety device that provides for operation at relatively low release forces.

SUMMARY OF THE INVENTION

A window covering is provided. One embodiment of my window covering includes a first rail, window covering material positioned adjacent to the first rail that is configured to move from an extended position to a retracted position, lift cords, a first pulley, a second pulley, a first pulley release device, and a second pulley release device. At least a portion of each lift cord extends from adjacent to the first rail to the window covering material. Each pulley is positioned such that at least one lift cord passes along that pulley.

The first pulley release device includes a male member and a female member. The female member has an opening sized and configured to releasably retain the male member of the first pulley release device such that the male member is released when a release force acts on the male member or the female member. One of the female member and the male member of the first pulley release device is attached to the first rail adjacent to the front surface of the window covering material and the other member of the first pulley release device is attached to the first pulley.

The second pulley release device also includes a male member and a female member. The female member of the second pulley release device has an opening sized and configured to releasably retain the male member of the second pulley release device such that the male member is released when a release force acts on the male member or the female member. One of the female member and the male member of the second pulley release device is attached to the first rail adjacent to the front surface of the first rail and the other member of the second pulley release device is attached to the second pulley.

Preferably, the first pulley and the second pulley are both positioned outside of the first rail adjacent to a front surface of the window covering material and a front surface of the first rail.

A lift mechanism may also be included in embodiments of my window covering. The lift mechanism may include a cord lock, a spring motor, interconnected spring motors, a tube lift, or other mechanism configured to control or maintain the position of the window covering material at any of a plurality of different positions between a fully extended or fully lowered position to a fully retracted or fully raised position. One embodiment of my window covering may include a cord lock attached to the first rail. A portion of each lift cord may extend through the cord lock. The window covering material may be composed of numerous different materials, such as fabric, woven wood or woven grass.

Embodiments of my window covering may include a second rail. The second rail may be a bottom rail or a bamboo rod such as a bamboo tube. The window covering material can be configured to roll up about the second rail when the window covering material is retracted.

The first rail may be a rod composed of bamboo, a tube composed of bamboo, an upper rail of a top down bottom up shade, or a headrail. The first rail may have a body that defines openings. The openings on the ends of the first rail may be sized and configured to receive end caps.

In some embodiments of my window covering, the female member of the first pulley release device may be attached to the first rail and the female member of the second pulley release device may be attached to the first rail. The male member of the first pulley release device may be attached to the first pulley and the male member of the second pulley release device may be attached to the second pulley.

In other embodiments of my window covering, the female member of the first pulley release device may be attached to the first pulley and the female member of the second pulley release device may be attached to the second pulley. The male member of the first pulley release device may be attached to the first rail and the male member of the second pulley release device may be attached to the first rail.

Preferably, the release force that the pulley release device separates at is between two and 10 pounds. It should be appreciated that the male and female members of each pulley release device may be sized and configured to separate at other forces as well.

One embodiment of my window covering is a roll-up shade that includes a first rail, window covering material positioned adjacent to the first rail, lift cords, a first pulley, a second pulley, a first pulley release device, a second pulley release device and cord release devices. The window covering material has an upper edge, a lower edge opposite the upper edge, a front surface extending between the upper edge and the lower edge and a rear surface extending between the upper edge and the lower edge. The window covering material is configured to move from an extended position to a retracted position such that the window covering material rolls up about the lower edge of the window covering material as the window covering material is retracted. Each lift cord has a first end and a second end opposite the first end. Each lift cord extends form adjacent the first rail to the window covering material. The first pulley and the second pulley are each positioned such that at least one lift cord passes along that pulley.

The first pulley release device includes a male member and a female member. The female member has an opening sized and configured to releasably retain the male member of the first pulley release device such that the male member is released when a release force acts on the male member or the female member. One of the female member and the male member of the first pulley release device is attached to the first rail adjacent to the front surface of the window covering material and the other member of the first pulley release device is attached to the first pulley.

The second pulley release device also includes a male member and a female member. The female member of the second pulley release device has an opening sized and configured to releasably retain the male member of the second pulley release device such that the male member is released when a release force acts on the male member or the female member. One of the female member and the male member of the second pulley release device is attached to the first rail adjacent to the front surface of the first rail and the other member of the second pulley release device is attached to the second pulley.

Each cord release device includes a mateable body and a receptacle. One of the mateable body and the receptacle is attached to the first rail adjacent to the rear surface of the window covering material and the other of the male body and the receptacle is attached to the second end of a respective lift cord.

Embodiments of the roll-up shade may also include a cord lock attached to the first rail. A portion of each lift cord extends through the cord lock.

The window covering material may be fabric, bamboo, woven wood or woven grass. Of course, other window covering material may also be used.

The first rail may be a rod composed of bamboo, a headrail, or an upper rail of a top down bottom up shade that is movable relative to a headrail. The first rail may be generally rectangular or tubular in structure. The first rail may also be configured as a rectangular structure with a central channel that has openings at two ends of the structure and at the top of the structure. For such a first rail, the openings at the two ends may be configured so that they may be covered by end caps.

A second rail may also be provided. The second rail may be attached to the lower edge of the window covering material. The window covering material may roll up about the second rail as the window covering material is retracted. The second rail may be a bamboo rod or a bottom rail. For example, the second rail may be a slat, a tube or a generally rectangular structure.

In some embodiments of my roll-up shade, the female member of the first pulley release device may be attached to the first rail and the female member of the second pulley release device may be attached to the first rail. The male member of the first pulley release device may be attached to the first pulley and the male member of the second pulley release device may be attached to the second pulley.

In other embodiments of my roll-up shade, the female member of the first pulley release device may be attached to the first pulley and the female member of the second pulley release device may be attached to the second pulley. The male member of the first pulley release device may be attached to the first rail and the male member of the second pulley release device may be attached to the first rail.

Other embodiments of my window covering include a first rail, window covering material positioned adjacent to the first rail that is configured to move from an extended position to a retracted position, lift cords that extend from adjacent the first rail to the window covering material, a first pulley positioned so that at least one lift cord passes along that pulley and a first pulley release device. The first pulley release device includes a male member and a female member. The female member has an opening sized and configured to releasably retain the male member such that the male member is released when a release force acts on the male member or the female member. One of the female member and the male member of the first pulley release device is attached to the first rail adjacent to the front surface of the window covering material and the other member of the first pulley release device is attached to the first pulley.

Some embodiments of my window covering may include a female member of the first pulley release device that has a resilient member positioned at least partially within the opening. The resilient member may be a spring such as a metal spring that includes at least one sinuous portion or an elastomeric member. In some embodiments of my window covering, the female member may be attached to the first pulley and the male member may be attached to the first rail. For example, the male member may be attached to the first rail such that the male member is integral with the first rail. The male member may be composed of metal or a polymeric material such as plastic and be molded into the first rail or may be formed in the first rail via an extrusion process. As another example, the male member may be fastened to the first rail via a fastening mechanism or an adhesive.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my window covering are shown in the accompanying drawings and certain present preferred methods of practicing the same are also illustrated therein.

DESCRIPTION OF PRESENT PREFERRED EMBODIMENTS

Figure 1:
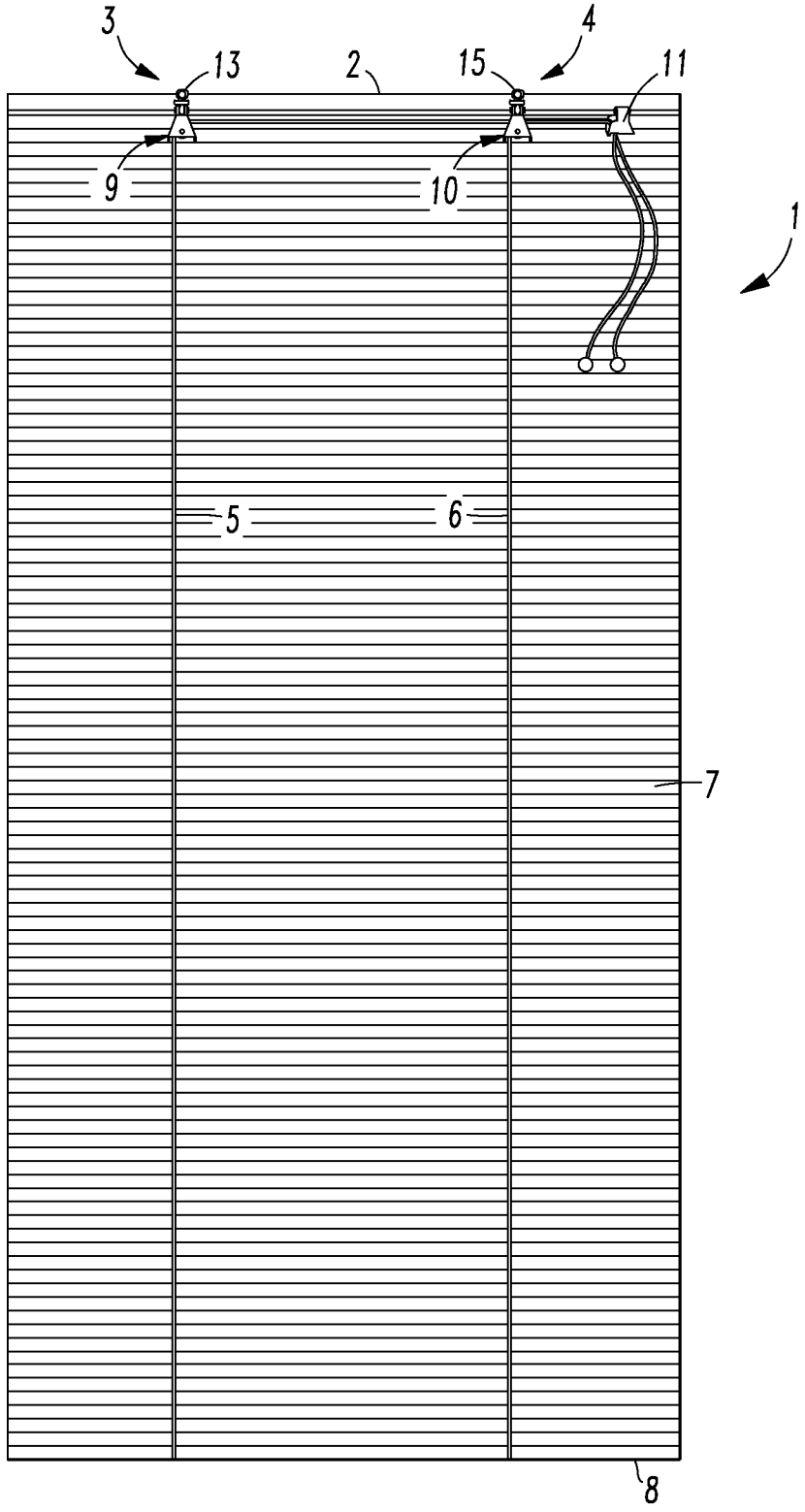
FIG. 1 is a front view of a first present preferred embodiment of my window covering in an extended position.
Figure 2:
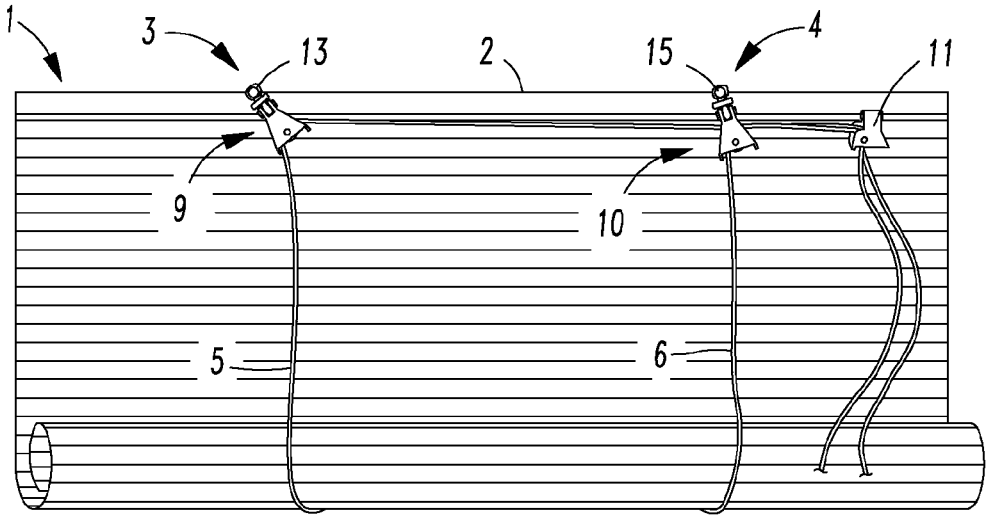
FIG. 2 is a front view of the first present preferred embodiment of my window covering in a retracted position.
Figure 3:
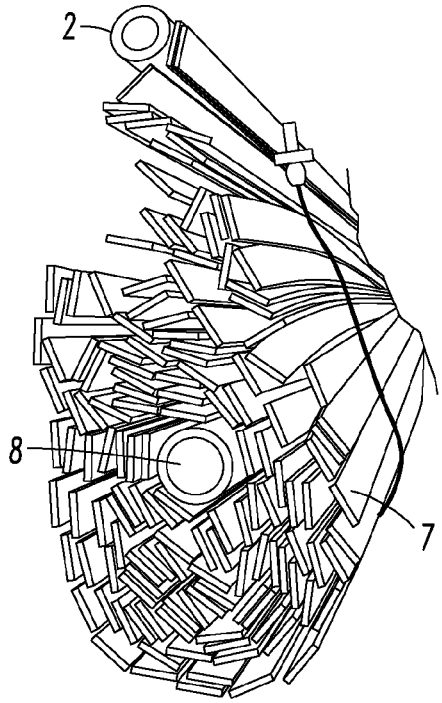
FIG. 3 is a side view of the first present preferred embodiment of my window covering in a retracted position.
Figure 4:
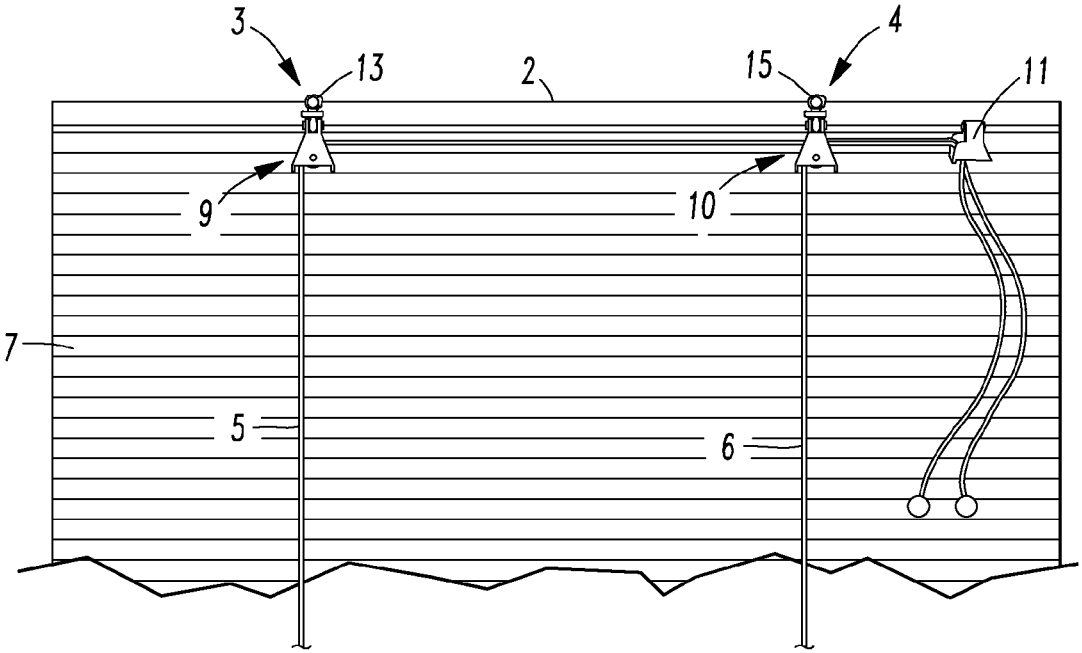
FIG. 4 is a fragmentary front view of the first present preferred embodiment of my window covering showing the pulley release devices connecting the pulleys to the headrail.
Figure 5:
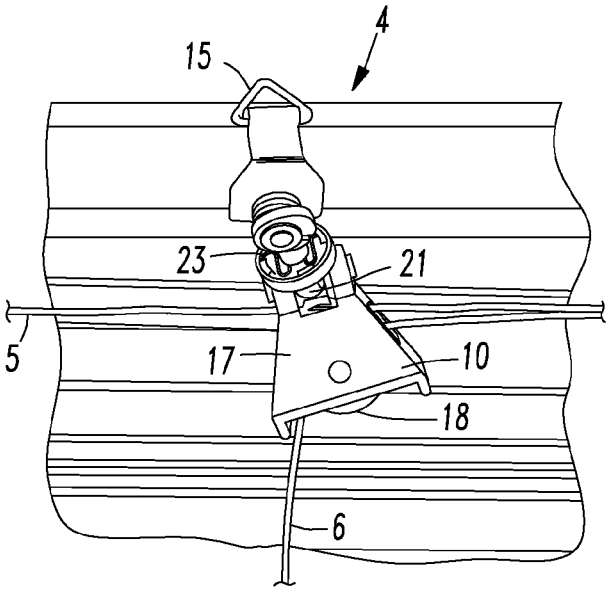
FIG. 5 is an enlarged view of a present preferred pulley release device connecting a pulley to a headrail.
Figure 6:
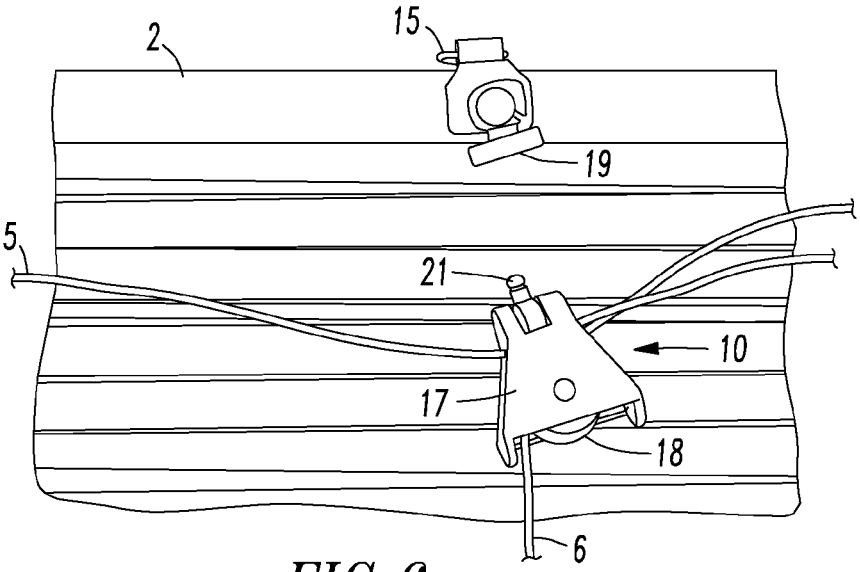
FIG. 6 is an is an enlarged view of a present preferred pulley release device showing the pulley release device having released the pulley from the headrail as a result of a release force acting on at least a component of the pulley release device.
Figure 8:
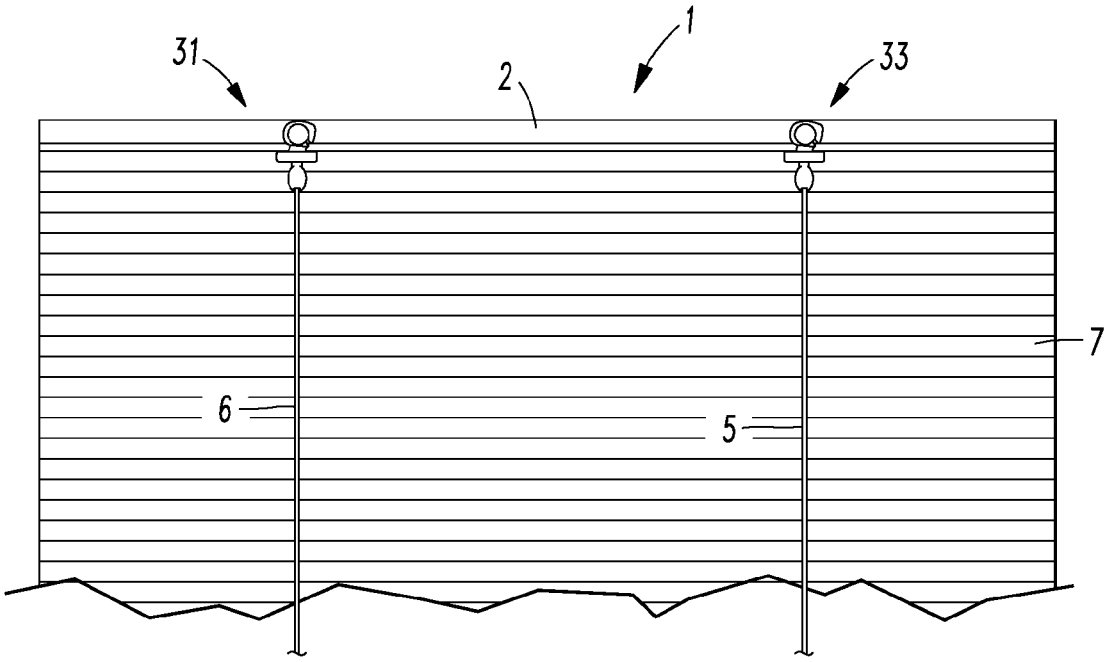
FIG. 8 is a fragmentary rear view of the first present preferred embodiment of my window covering showing cord release devices connecting terminal ends of the lift cords to the headrail.
Figure 7:
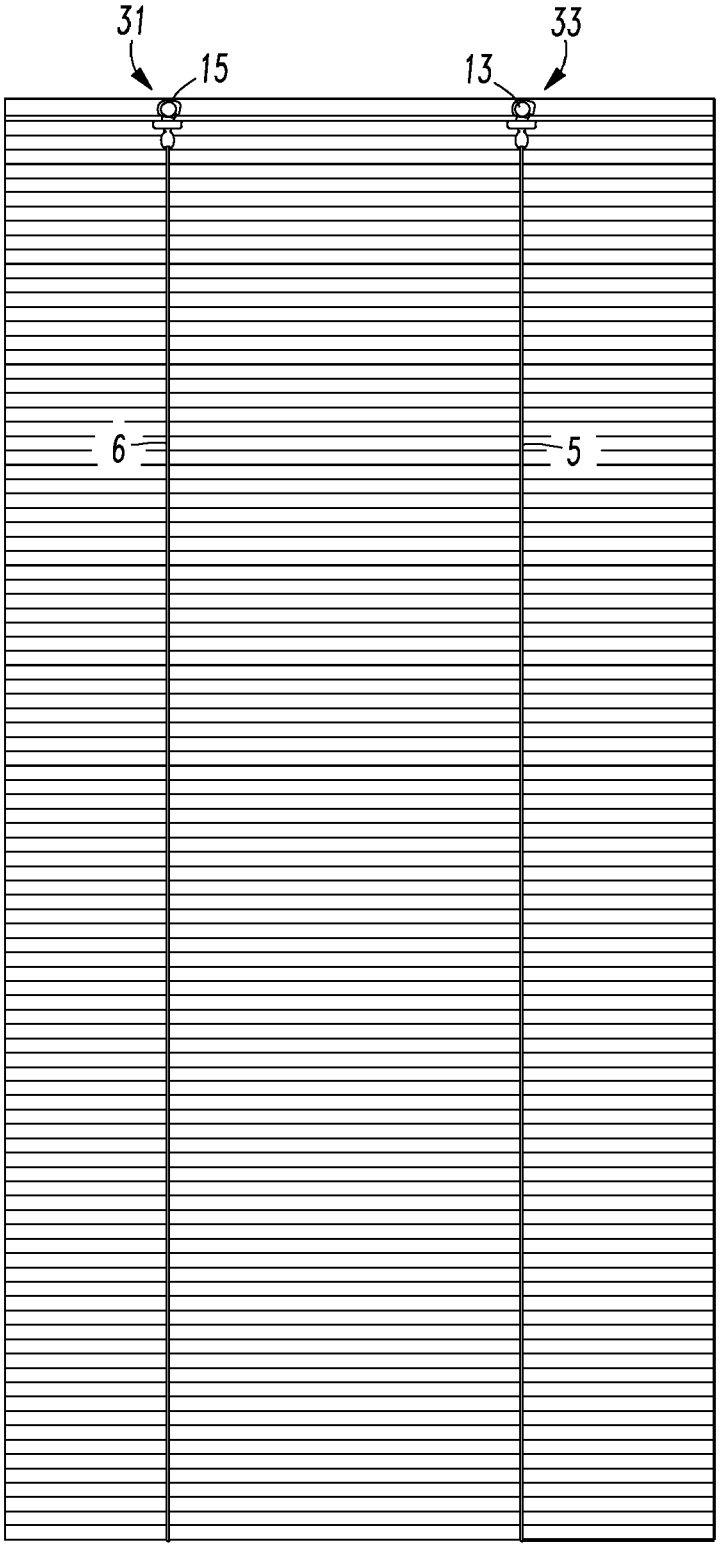
FIG. 7 is a rear view of the first present preferred embodiment of my window covering.
Figure 9:
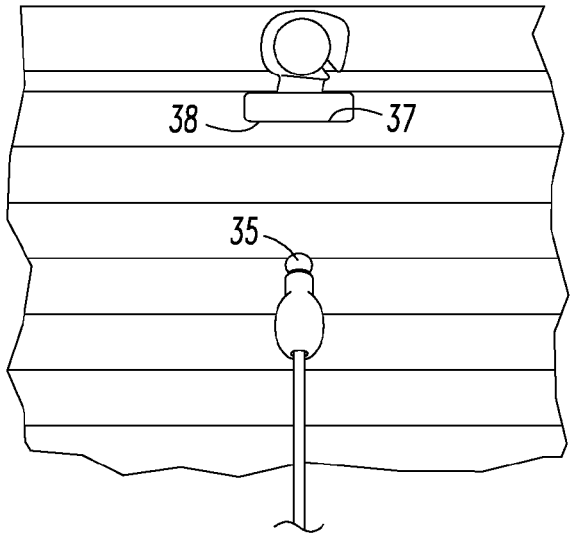
FIG. 9 is an enlarged view illustrating a present preferred cord release device releasing a terminal end of a lift cord from the headrail as a result of a release force acting on a component of the cord release device.

Referring to FIGS. 1-9, a window covering 1 includes a headrail 2, a cord lock 11 attached to the headrail 2 and lift cords that extend from the headrail 2. The lift cords extend from adjacent the headrail 2 to window covering material 7 such that the window covering material 7 may be extended to cover a window or retracted to uncover a window when the window covering is mounted in or adjacent to a window or window opening. It should be understood that other embodiments of window coverings may include an alternative to the cord lock 11, such as a spring motor, interconnected spring motors, tube lift mechanism or other lift mechanism.

The window covering 1 is configured to roll-up the window covering material 7 as the window covering material is retracted, or raised. The lift cords 5, 6 extend from the cord lock 11 adjacent to the front surface of the window covering material and adjacent to the headrail 2 to the bottom edge of the window covering material and a bottom rail 8 attached to the bottom edge of the window covering material 7. The lift cords pass around the bottom edge of the window covering material and the bottom rail 8 and pass along the rear surface of the window covering material 7 to the headrail 2 of the window covering. A terminal end of each lift cord is attached to the rear of the headrail 2 adjacent to the rear surface of the window covering material 7. Preferably, the lift cords are attached to the headrail 2 by cord release devices 31 and 33.

The window covering material is preferably composed of woven wood, woven grass or fabric. If the window covering material is composed of woven wood, the headrail 2 and bottom rail 8 are preferably tubes or rods composed of bamboo. Of course, other embodiments may utilize different rail configurations for the headrail 2 and bottom rail 8. For instance, the headrail 2 may alternatively be a generally rectangular structure that includes an open top and end openings that are covered by end caps or may be a tubular structure. As another example, the bottom rail 8 may alternatively be a generally flat rectangular structure, a tube, or a slat. Of course, it should be understood that some embodiments of my window covering may not include a bottom rail.

The window covering 1 is preferably configured as a roll-up shade. When a user manipulates operator portion of the lift cords that extend from the cord lock 11, the user may raise the window covering material or lower the window covering material 7. The operator portion of each lift cord may include a tassel or other structure attached to a terminal end of a lift cord to block that end from passing through the cord lock and to make the cords easy for a user to grab and manipulate. Pulling the lift cords can cause the window covering material 7 to retract such that the window covering material rolls about its bottom edge and the bottom rail 8. Manipulating the lift cords to pass through the cord lock 11 to lower the window covering material 7 can causes the window covering material 7 to extend and unroll about its bottom edge and the bottom rail 8.

Of course, other embodiments of my window covering may include a Roman shade, a venetian blind, a top down bottom up shade, or other shade designs or blind designs.

The lift cords extend from the cord lock 11 and pass along pulleys 9, 10 to the window covering material 7. The first pulley 10 is configured to permit both lift cords 5 and 6 to pass along the pulley 10. A first lift cord 5 passes along the pulley 10 to a second pulley 9. A second lift cord 6 passes along the first pulley 10 and extends toward the bottom edge of the window covering material 7 and the bottom rail 8. The first lift cord 5 passes along the second pulley 9 and extends toward the bottom edge of the window covering material 7 and the bottom rail 8 so that the first lift cord 5 is parallel to the second lift cord 6.

The first pulley 10 is attached to the headrail 2 by a first pulley release device 4 and the second pulley 9 is attached to the headrail 2 by a second pulley release device 3. A fastening mechanism 13 attaches the second pulley release device 3 to the headrail 2 and a fastening mechanism 15 also attaches the first pulley release device 4 to the headrail 2.

Each pulley includes a pulley carriage 17 or cradle and a wheel 18. The wheel 18 is configured to roll about an axle that is attached to the pulley carriage 17. Each pulley carriage is preferably attached adjacent to a front surface of the window covering material 7 and is positioned outside of the headrail 2.

Some embodiments of my window covering may include a valance. The pulleys may be attached to the headrail such that the pulley carriages are hidden from view by the valance or are positioned between the valance and the headrail.

Each pulley release device includes a female member 19 and a male member 21. The male member 21 may be attached to the pulley 10. For example, the male member 21 may be attached to the pulley carriage 17. The female member 19 may be attached to the headrail 2 via a fastening mechanism 15. The female member 19 and male member 21 may be composed of a polymeric material such as ABS or polypropylene or may be composed of metal or some other material.

The female member 19 preferably includes an opening sized to receive the male member 21 and a spring 23 that is at least partially positioned in the opening of the female member 19. The spring 23 is preferably positioned partially within the opening so that the male member 21 is releasably received within the opening such that an application of a certain force causes the male member 21 to release from the female member 19. The release force is preferably between two pounds and ten pounds acting in a generally downward direction.

The spring 23 may be composed of metal, a polymeric material or an elastomeric material. The spring may also be configured to be any number of different shapes or sizes. Preferably, the spring is composed of metal and at least a portion of the spring is wavy or sinuous. The spring 23 may also be other types of resilient members.

Figure 10:
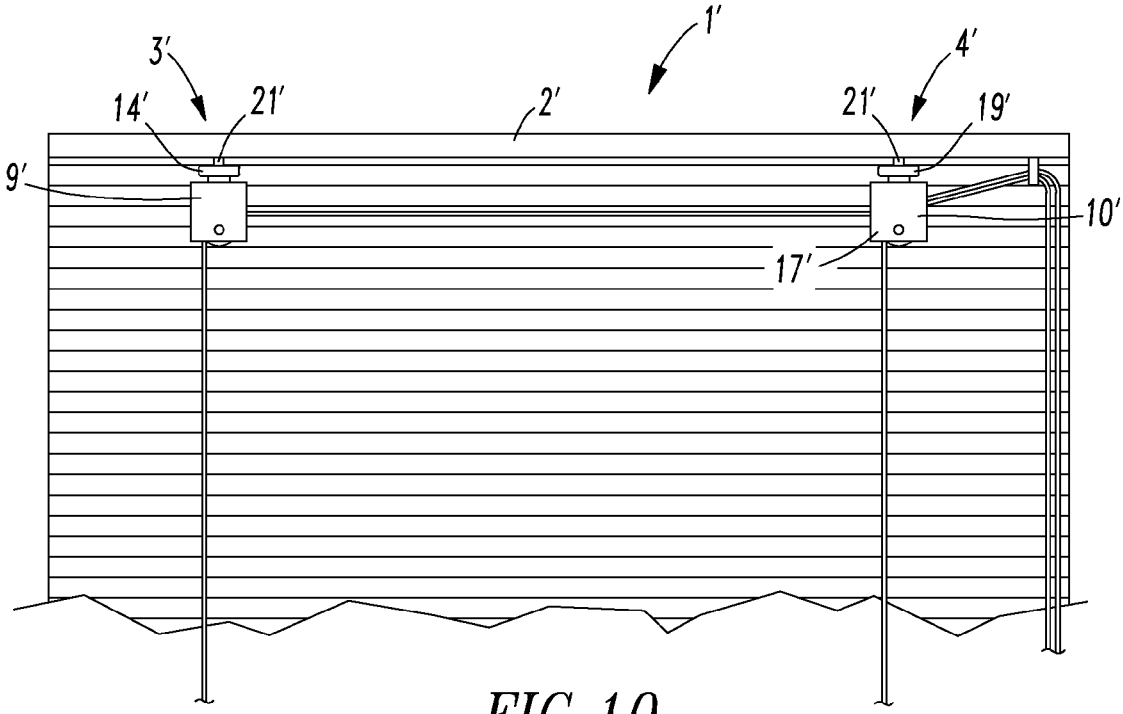
FIG. 10 is an enlarged bottom view of a present preferred female member of a pulley release device illustrating a present preferred spring positioned within a receptacle formed in the female member.

It is also contemplated that the male members '21 of each pulley release device '3 and '4 may be attached to the headrail '2 and the female members '19 may be attached to the pulleys '9, '10 as may be appreciated from the embodiment of the window covering shown in FIG. 10. Each female member '19 may be attached to a pulley carriage '17 or other pulley component and each male member '21 may be attached to the headrail via a fastening mechanism or may be formed integral with the headrail. For example, a headrail may be composed of metal or plastic and have male members formed in the headrail such that the male members are integral with the headrail via a molding process such as extrusion or injection molding. Each female member may then be attached to a respective pulley for releasable connection to a respective male member integrally attached to the headrail.

When a release force acts on the male or female member of the pulley release device, the pulley to which that pulley release device is attached may be released from the headrail. Such a release of the pulley or pulleys may prevent the lift cords from strangling a child or becoming entangled with a child by preventing the formation of nooses or taught loops formed when a child, may be interacting with the window covering without any supervision. It should be appreciated that the female and male members of the pulley release devices may be sized and configured to disconnect a pulley from a headrail for accommodating any particular industry standard or government standard that may be established.

Figure 11:
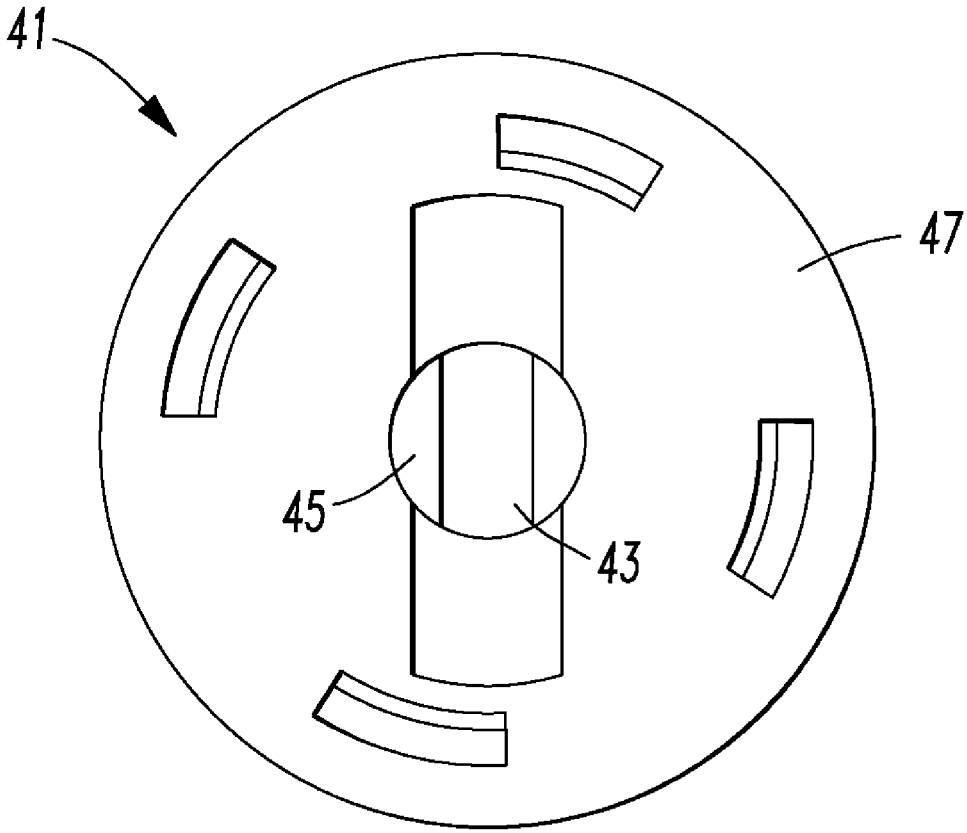
FIG. 11 is a rear view of a second present preferred embodiment of my window covering.

Preferably, the female members 41 of the pulley release devices include a body 42 that has an opening 43 as may be seen in FIG. 11. The body 42 is sized and configured to retain a spring 45 such that at least a portion of the spring 45 extends into the opening 43 for releasably retaining at least a portion of a male member. The receptacles of the cord release devices may also include bodies similar to body 42 and a spring to releasably retain a mateable body.

A terminal end opposite the operation cord portion of each lift cord may be attached to a respective cord release device. For example, a terminal end of the first lift cord 5 may be connected to a first cord release device 33 and a terminal end of the second lift cord 6 may be connected to a second cord release device 31. The cord release devices may each include a mateable body 35 and a receptacle 37. The receptacle 37 includes an opening 38 sized and configured to releasably receive the mateable body 35. A spring is also preferably positioned at least partially within the opening 38 so that the receptacle may releasably retain the mateable body 35. The receptacle is preferably configured to release the mateable body upon application of a release force of between two and ten pounds.

It is also contemplated that other embodiments of my window covering may include cord release devices that have mateable bodies attached to the headrail and female bodies attached to the terminal ends of the lift cords. As another alternative, cord release devices may be used to releasably attach a terminal end of a lift cord to a bottom rail. For example, embodiments of my window covering that are configured as Roman shades may include pulley release devices attached to the headrail and cord release devices attached to a bottom rail or a bottom portion of the window covering material. For such a Roman shade, the one or more pulley release devices would preferably be attached to the headrail adjacent to the rear surface of the window covering material.

It is contemplated that other embodiments of my window covering may include only pulley release devices. It is also contemplated that embodiments of my window covering may only include one pulley release device instead of multiple pulley release devices. That pulley release device may be configured to release only one pulley or multiple pulleys. That being said, I prefer that the window coverings include both pulley release devices in combination with cord release devices.

It should be appreciated that other variations of the present preferred embodiments discussed above may be made. For example, the number of lift cords required for any particular window covering can vary according to the size and weight of the shade material as well as the release force required to separate the pulley release device or cord release device attached to the shade. As another example pulley release devices may include male members that have different shapes or sizes than those described above. As yet another example, the pulley release devices may also include female members that have openings or receptacles that are configured for releasable connection to the male members that have different sizes or shapes than those described above.

While certain present preferred embodiments of my window covering and certain embodiments and methods of practicing the same have been shown and described, it is to be distinctly understood that the invention is not limited thereto but may be otherwise variously embodied and practiced within the scope of the following claims.

I claim:

1. A roll-up shade comprising:

a first rail;

window covering material positioned adjacent to the first rail, the window covering having an upper edge adjacent to the first rail, a lower edge opposite the upper edge; a front surface extending between the upper edge and lower edge and a rear surface extending between the upper edge and the lower edge, the window covering material configured to move from an extended position to a retracted position such that the window covering material rolls up about the lower edge of the window covering material as the window covering material is retracted;

a plurality of lift cords, each lift cord having a first end and a second end opposite the first end, each lift cord extending from adjacent the first rail to the window covering material;

a first pulley and a second pulley, each pulley positioned such that at least one of the lift cords passes along that pulley;

a first pulley release device, the first pulley release device comprising a male member and a female member, the female member of the first pulley release device having a receptacle sized and configured to releasably retain the male member of the first pulley release device such that the male member is released when a release force acts on the male member or the female member, one of the female member and the male member of the first pulley release device being attached to the first rail adjacent to the front surface of the window covering material, and the other member of the first pulley release device being attached to the first pulley;

a second pulley release device, the second pulley release device comprising a male member and a female member, the female member of the second pulley release device having a receptacle sized and configured to releasably retain the male member of the second pulley release device such that the male member is released when a release force acts on the male member or the female member, one of the female member and the male member of the second pulley release device being attached to the first rail adjacent to the front surface of the first rail and the other member of the second pulley release device being attached to the second pulley; and a plurality of cord release devices, each cord release device comprising a mateable body and a receptacle, one of the mateable body and the receptacle attached to the first rail adjacent to the rear surface of the window covering material and the other of the male body and the receptacle attached to the second end of a respective lift cord.

2. The roll-up shade of claim 1 further comprising a cord lock attached to the first rail, a portion of the lift cords extending through the cord lock, and wherein the window covering material is woven wood, woven grass, bamboo, or fabric.

3. The roll-up shade of claim 1 wherein the first rail is a tube composed of bamboo or a headrail.

4. The roll-up shade of claim 1 further comprising a second rail attached to the lower edge of the window covering material, the window covering material also rolling up about the second rail as the window covering material is retracted.

5. The roll-up shade of claim 4 wherein the second rail is a bamboo rod or a bottom rail.

6. The roll-up shade of claim 1 wherein the female member of the first pulley release device is attached to the first rail and the female member of the second pulley release device is attached to the first rail and wherein the male member of the first pulley release device is attached to the first pulley and the male member of the second pulley release device is attached to the second pulley.

7. The roll-up shade of claim 1 wherein the female member of the first pulley release device is attached to the first pulley and the female member of the second pulley release device is attached to the second pulley and wherein the male member of the first pulley release device is attached to the first rail and the male member of the second pulley release device is attached to the first rail.

8. A window covering comprising a first rail;

window covering material positioned adjacent to the first rail, the window covering material configured to move from an extended position to a retracted position;

a plurality of lift cords, at least a portion of each lift cord extending from adjacent the first rail to the window covering material;

a first pulley and a second pulley, each pulley positioned such that at least one of the lift cords passes along that pulley;

a first pulley release device, the first pulley release device comprising a male member and a female member, the female member of the first pulley release device having an opening sized and configured to releasably retain the male member of the first pulley release device such that the male member is released from the opening when a release force acts on the male member or the female member, one of the female member and the male member of the first pulley release device being attached to the first rail and the other member of the first pulley release device being attached to the first pulley; and a second pulley release device, the second pulley release device comprising a male member and a female member, the female member of the second pulley release device having an opening sized and configured to releasably retain the male member of the second pulley release device such that the male member is released from the opening when a release force acts on the male member or the female member, one of the female member and the male member of the second pulley release device being attached to the first rail and the other member of the second pulley release device being attached to the first pulley.

9. The window covering of claim 8 wherein the first pulley is positioned outside of the first rail adjacent to a front surface of the window covering material and a front surface of the first rail and the second pulley is positioned outside of the first rail adjacent to a front surface of the window covering material and a front surface of the first rail.

10. The window covering of claim 8 further comprising a cord lock attached to the first rail, a portion of each lift cord extending through the cord lock, and wherein the window covering material is woven wood, woven grass, or fabric.

11. The window covering of claim 8 wherein the first rail is a tube composed of bamboo or a headrail.

12. The window covering of claim 8 further comprising a second rail attached to a lower edge of the window covering material and wherein the window covering material is configured to roll up about the second rail as the window covering material is retracted.

13. The window covering of claim 12 wherein the second rail is a bamboo tube or a bottom rail.

14. The window covering of claim 8 wherein the female member of the first pulley release device is attached to the first rail and has a spring positioned at least partially within the receptacle and the female member of the second pulley release device is attached to the first rail and has a spring positioned at least partially within the receptacle and wherein the male member of the first pulley release device is attached to the first pulley and the male member of the second pulley device is attached to the second pulley.

15. The window covering of claim 14 wherein the release force is between 2 pounds and 10 pounds.

16. A window covering comprising a first rail;

window covering material positioned adjacent to the first rail, the window covering material configured to move from an extended position to a retracted position;

a plurality of lift cords, each lift cord extending from adjacent the first rail to the window covering material;

a first pulley positioned such that at least one of the lift cords passes along that pulley; and a first pulley release device, the first pulley release device comprising a male member and a female member, the female member of the first pulley release device having an opening sized and configured to releasably retain the male member of the first pulley release device such that the male member is released from the opening when a release force acts on the male member or the female member, one of the female member and the male member of the first pulley release device being attached to the first rail and the other member of the first pulley release device being attached to the first pulley.

17. The window covering of claim 16 wherein the first pulley is positioned outside of the first rail adjacent to a front surface of the window covering material and a front surface of the first rail.

18. The window covering of claim 16 further comprising a cord lock attached to the first rail, a portion of each lift cord extending from a cord lock to the window covering material and wherein the window covering material is woven wood, woven grass, or fabric.

19. The window covering of claim 16 wherein the first rail is a tube composed of bamboo or a headrail.

20. The window covering of claim 16 wherein the female member of the first pulley release device is attached to the lift cord and has a resilient member positioned at least partially within the opening.

21. The window covering of claim 16 further comprising a plurality of cord release devices, each cord release device comprising a mateable body and a receptacle, one of the mateable body and the receptacle attached to the window covering adjacent to the window covering material and the other of the male body and the receptacle attached to an end of a respective one of the lift cords.

22. The window covering of claim 8 further comprising a plurality of cord release devices, each cord release device comprising a mateable body and a receptacle, one of the mateable body and the receptacle attached to the window covering adjacent to the window covering material and the other of the male body and the receptacle attached to an end of a respective one of the lift cords.

* * * * *